United States Patent [19]

Sapienza, IV et al.

[11] Patent Number: 4,878,461

[45] Date of Patent: Nov. 7, 1989

[54] VARIABLE CAMSHAFT TIMING SYSTEM

[75] Inventors: Samuel J. Sapienza, IV, Hampton; Willem N. J. van Vuuren, Williamsburg; Benjamin G. Shirey, Hampton; Russell J. Wakeman, Newport News, all of Va.

[73] Assignee: Siemens-Bendix Automotive Electronics L.P., Troy, Mich.

[21] Appl. No.: 213,651

[22] Filed: Jun. 30, 1988

Related U.S. Application Data

[63] Continuation-in-part of Ser. No. 181,867, Apr. 15, 1988, which is a continuation of Ser. No. 17,670, Feb. 24, 1987, Pat. No. 4,744,338.

[51] Int. Cl.[4] ..... F01L 1/34

[52] U.S. Cl. ..... 123/90.15; 474/900

[58] Field of Search ..... 123/90.15, 90.16, 90.17, 123/90.31; 474/84, 86, 101, 133, 134

[56] References Cited

U.S. PATENT DOCUMENTS

| | | | |
|---|---|---|---|
| 3,888,217 | 6/1975 | Hisserich | 123/90.15 |
| 4,576,127 | 3/1986 | Doi et al. | 123/90.15 |
| 4,685,429 | 8/1987 | Oyaizu | 123/90.15 |
| 4,744,338 | 5/1988 | Sapienza, IV | 123/90.15 |

FOREIGN PATENT DOCUMENTS

| | | | |
|---|---|---|---|
| 166705 | 8/1985 | Japan | 123/90.15 |

*Primary Examiner*—Noah P. Kamen

*Attorney, Agent, or Firm*—Russel C. Wells; George L. Boller

[57] ABSTRACT

A variable camshaft timing system for an internal combustion engine varies the relative angular position between the intake camshaft and the exhaust camshaft by controlling the path of the timing belt means. A first belt means is interconnected at one end of the engine between the crankshaft and the exhaust camshaft. At the other end of the engine the intake camshaft and the exhaust camshaft are connected by a second belt means for rotating the intake camshaft from the rotational drive supplied via exhaust camshaft. Idler arms are positioned for controlling the path and tension in the second belt means for varying the timing of the intake camshaft relative to the exhaust camshaft. A motor means operates to position the idler arms through a positioning cam means. The motor is controlled from an electronic control unit which receives signals indicating the engine operating characteristics and through a look-up table steps the positioning cam means to pivot the idler arms to rotate the intake camshaft relative to the exhaust camshaft thereby changing the intake valve timing.

8 Claims, 5 Drawing Sheets

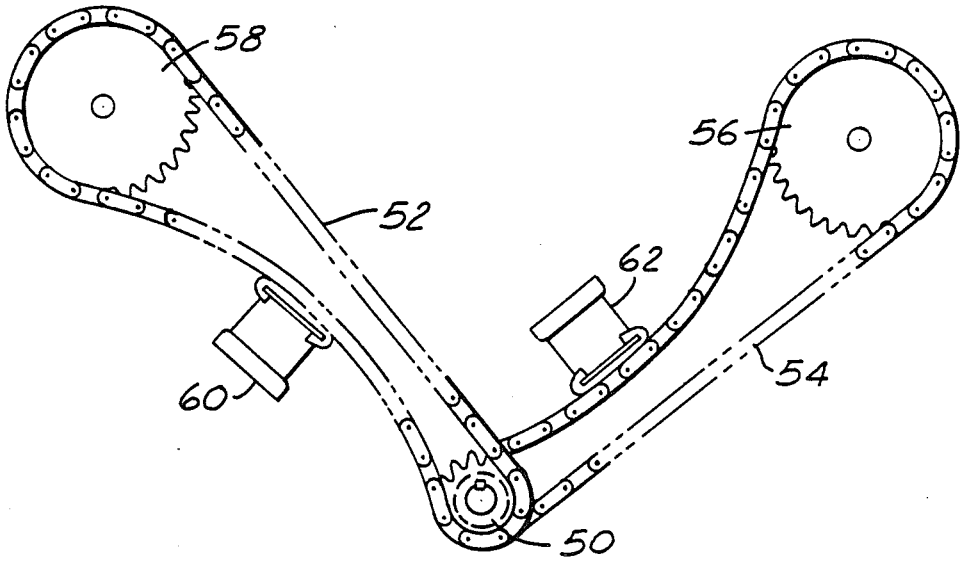
FIG.3
FIG.6
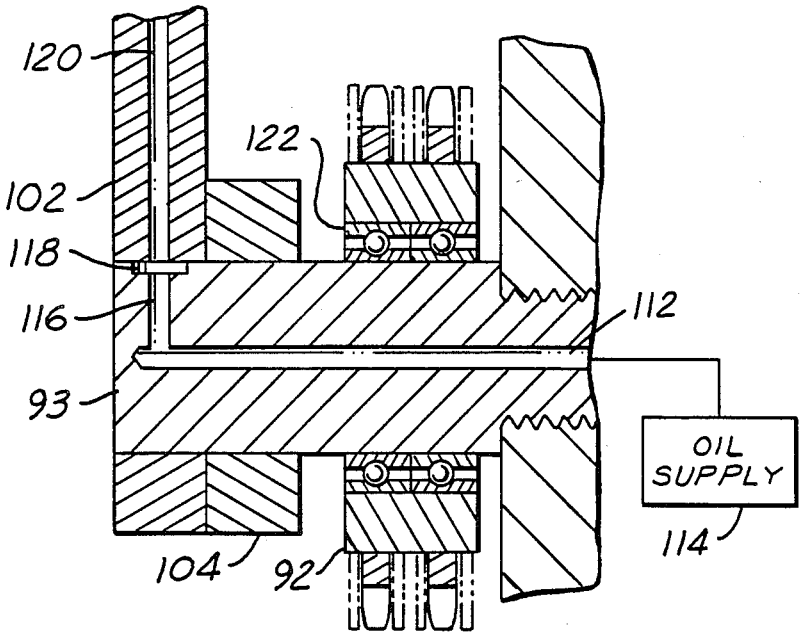

VARIABLE CAMSHAFT TIMING SYSTEM

This application is a continuation-in-part of U.S. Ser. No. 181,867 filed Apr. 15, 1988, which is a continuation of Ser. No. 017,670 filed Feb. 24, 1987 now U.S. Pat. No. 4,744,338 issued May 17, 1988.

This invention relates to timing systems for internal combustion engines and more particularly to electronic control systems for variable camshaft timing systems as may be found on overhead cam engines.

BACKGROUND OF INVENTION

Prior Art

Prior art systems such as that shown in U.S. Pat. No. 4,484,543, entitled "Adjustable Non-throttling Control Apparatus For Spark Ignition Internal Combustion Engines" illustrate the changing of the belt length from two shafts. Along the belt path is a pair of idler wheels, wherein one wheel is moved by an external mechanism, such as a throttle of an engine, and the other wheel is moved under the force of a spring. In this system, a constant level of tension in the belt is not maintained.

U.S. Pat. No. 4,438,737, entitled "Apparatus and Method For Controlling The Valve Operation of an Internal Combustion Engine" illustrates a pair of idler arms controlling the path of a timing belt from the crankshaft to the camshaft. The upper idler arm is controlled by an electric motor which changes the length of a rod to pivot the upper idler arm. The lower idler arm follows the belt. The tension level in the belt is not maintained.

U.S. Pat. No. 4,530,318, entitled "Intake and Exhaust Valve System For Internal Combustion Engine" illustrates a means for moving the position of a controlled idler pulley between two driven pulleys to change the relative position of each of the driven pulleys relative to each other. A pair of idler pulleys is adjusted by the belt as the controlled idler pulley is repositioned. The tension level in the belt is not maintained.

U.S. Pat. No. 3,986,484, entitled "Camshaft for Controlling Variably Opening Valves" illustrates a linkage means for axially moving a camshaft while at the same time transversely moving a pair of idler wheels on the belt between a crankshaft and a pair of camshafts. The idler rollers are in a rigid spatial relationship on either side of one of the camshafts. As the camshafts are axially moved, the angular relationship between the two camshafts is altered. In this system the tension level in the belt is not maintained since both idler rollers move the same amount.

In all of the above systems, the tension level in the belts or chains being variable will provide inaccurate timing during each engine operation and harmfull stresses on the belts or chains.

SUMMARY OF INVENTION

It is principle object and advantage Of this invention to maintain optimum intake event timing on a twin camshaft engine throughout the speed range and operating conditions of the engine.

It is an advantage of this invention to schedule which outputs of the internal combustion engine will be optimized such as idle quality could be optimized at idle; hydrocarbons in the emissions could be minimized at part throttle conditions; or torque could be maximized at wide open throttle.

These and other objects and advantages will be apparent in the variable timing system in combination with an internal combustion engine having an engine crankshaft or moveable member. An exhaust camshaft is mounted for rotation and extends from the engine. The exhaust camshaft has at least one exhaust cam for controlling the opening and closing of at least one exhaust valve. An intake camshaft is also mounted for rotation on the engine and extends from the engine. The intake camshaft has at least one intake cam for controlling the opening and closing of at least one intake valve. A pulley wheel means is attached to one end of each of the crankshaft, the exhaust camshaft and the intake camshaft. At least one of the pulley wheel means on either the crankshaft and exhaust camshaft effectively functions as a double pulley wheel means.

At least two chains or belt means are used for interconnecting each of the pulley wheel means with the pulley wheel means functioning as a double pulley wheel means. At least two idler wheels are in operative contact with the belt means around the pulley wheel means on the intake camshaft. A lever means is pivotally mounted for supporting the idler wheels. Typically there are two separate lever means and each has a caming surface. A positioning cam means is mounted in operative contact with the caming surface of each lever for pivoting each lever means to rotate the intake camshaft relative to the exhaust camshaft. A sensor means positioned adjacent to the intake camshaft senses the angular position of the intake camshaft and generates a signal which is supplied to a control means for positioning the positioning cam means.

Many other objects and purposes of the invention will be clear from the following detailed description of the drawings.

BRIEF DESCRIPTION OF THE DRAWINGS

In the Drawings:

FIG. 3 is a front view of a V-8 engine having another embodiment of the variable camshaft timing mechanism.

FIG. 6 is a sectional view taken along line 6—6 of FIG. 5.

Figure 1:
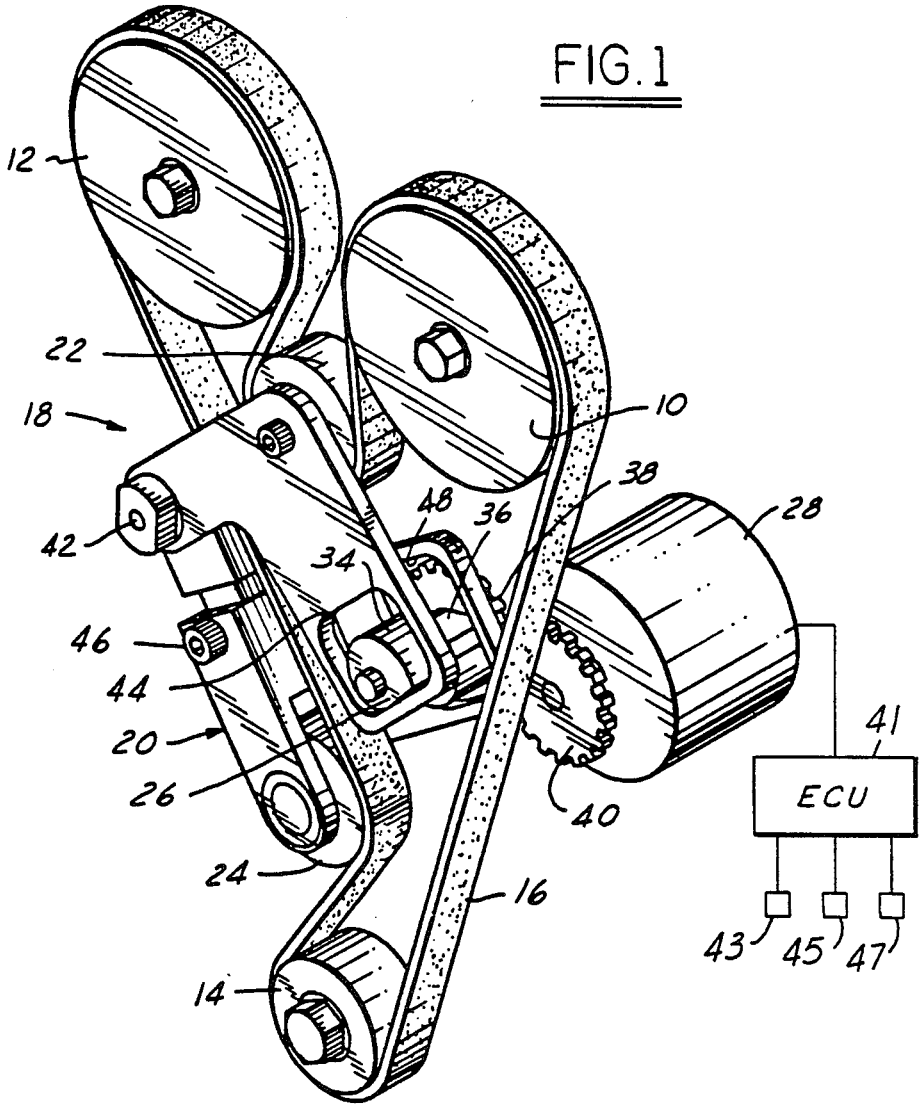
FIG. 1 is a perspective view of a variable camshaft timing mechanism.

DETAILED DESCRIPTION:

There will be described herein an apparatus and a method for varying the camshaft timing for an internal combustion engine having at least one cylinder, a rotatable member such as a crankshaft, and an intake and exhaust valve for the one cylinder. The valves are coupled to an intake camshaft and an exhaust camshaft respectively. A pulley wheel means 10,12,14 is attached at one end of each of the intake and exhaust camshafts and the crankshaft of the engine with a belt means 16 interconnecting each of the pulley wheels for transferring rotational motion from the crankshaft to the intake and exhaust camshafts.

A first 18 and second 20 idler arm means are fastened to the engine for pivotable movement. Attached to each of the idler arm means is an idler wheel 22,24 positioned in operative contact with the belt means 16. positioning means 26 are positioned in operative contact with each of the idler arm means 18,20 to pivotally move the idler arm means. Control signals are generated according to engine operating characteristics and are applied through motor means 28 for rotating the positioning means 26 to pivotally move the idler arm means 18,20 changing the relative rotational position between the input camshaft and the exhaust camshaft. It is understood that motor means includes many forms of power transmission such as, electric motors, hydraulic systems, pneumatic systems, etc. by which the positioning means 26 can be positioned.

FIG. 1 illustrates the apparatus for the timing system which is located between the crankshaft and the two camshafts of a typical overhead camshaft internal combustion engine. The crankshaft or moveable member of the engine has a pulley wheel means 14 attached at one end thereof. Each of the camshafts also has pulley wheel means attached thereto.

For the purpose of description of FIG. 1, the intake camshaft is located to the left of the exhaust camshaft. Attached to the intake camshaft are at least one timing cam having a plurality of cam lobes, not shown, which operate to control the movement of the intake valve for each engine cylinder. In a similar manner, attached to the exhaust camshaft are at least one timing cam having a plurality of cam lobes, not shown, controlling the movement of the exhaust valve for each engine cylinder. None of the mechanisms which are typically axially positioned on the camshaft from the pulley wheels are shown.

Interconnecting the three pulley wheels is a belt means 16 which may take the form of conventional timing belt, a chain or any other type of flexible member. The tension level in the belt means is maintained by an idler arm means 18,20 comprising an upper or first idler wheel arm 30, an upper idler wheel 22, a lower or second idler wheel arm 32 and a lower idler wheel 24. The idler arm means 18,20 are controlled by a pair of cams 34,36 of a positioning means 26 operatively connected through a gear means 38,40 to the output of a motor means such as an electric motor 28.

In addition if the belt means is a chain, a hydraulic chain tensioner such as that manufactured by Renold under GM Part Numbers 22531787 and 22536985 may be provided. This hydraulic chain tensioner must be positioned on the slack side of the chain between two non-moveable but rotatable pulley wheel means. The basic operation of the hydraulic chain tensioner is to extend the piston of the tensioner in response to the slacking of the chain. As the piston is extended, a rachet and pawl mechanism prevents the piston from retracting when the hydraulic pressure is reduced. It is for this reason, that the chain must be fixedly located on either side of the tensioner. The hydraulic fluid is generally the engine oil which is supplied to the tensioner mechanism by several oil passageways.

The motor is controlled from an Electronic Control Unit (ECU) 41 which responds to various engine operating sensors 34, 45, 47 for supplying information in the form of signals relative to the operation of the engine. Stored in a look-up table in the memory contained in the ECU are control signals for positioning the motor 28 in accordance with the desired relative valve timing cam positions at the particular engine operating condition.

In the embodiment of FIG. 1, the upper idler wheel arm 30 is a lever pivoted 42 at one end, the pivoting end, and at the other end the cam follower end, is a cam follower means 44. Positioned intermediate the ends of the lever, at the junction of the pivoting end and cam follower end is the upper idler wheel 22. The lower idler wheel 32 arm is a similar shaped lever with the lower idler wheel 24 positioned intermediate the ends of the lever. Both idler wheels 22,24 are rotatably mounted. As will hereinafter be illustrated, depending upon the geometry of the timing system the arms 30 and 32 may be different class levers. For purposes of adjusting for belt stretching, in the case of a rubber belt or when another tensioner is not be used, one of the legs, in this embodiment the pivoting leg of the lower idler arm 32, may have an adjustment means 46 for adjusting the length of the leg.

Figure 2:
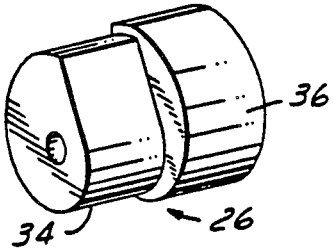
FIG. 2 is a perspective view of the positioning means of FIG. 1.

The positioning means 26 in the preferred embodiment is illustrated in FIG. 2. The lower cam 36, which is the cam nearest the gear wheel 38, positions the lower idler wheel 24 and the upper cam 34 which is fixedly attached to the lower cam 36, positions the upper idler wheel 22. The gear wheel 38 can be a sector gear wheel wherein the gear teeth are on only a portion of the perimeter of the wheel, a full gear or a rack. In a similar manner, the mating gear 40 which is driven by the motor means 28, may be a sector gear, a full gear wheel or a worm gear. The criteria for determining the shape of the gear wheels is a function of the control motor 28 and the gear ratio between the two gears. In some embodiments, a worm gear is attached to the motor means shaft and a gear wheel or rack is used to control the positioning means. The main purpose of the positioning means 26 and the motor means 28 is to control the relative angular positioning of the intake valve with the exhaust valve.

The operation of variable camshaft timing system is under the control of the ECU 41. The belt means 16 is positioned around the intake camshaft pulley 12, the upper idler wheel 22 and the exhaust camshaft pulley 10. The belt means 16 from the exhaust camshaft pulley 10, the load, extends directly to the crankshaft pulley wheel 14, the drive, which is the tension portion of the belt means. The belt 16 wraps around the crankshaft pulley wheel 14 and around the lower idler wheel 24 to the intake camshaft pulley wheel 12 which is the slack portion of the belt means. By adjusting the position of the idler wheels 22,24, this endless loop will angularly position the intake camshaft relative to the exhaust camshaft and thereby change the timing of the intake valves of each cylinder of the engine and maintain a predetermined tension in the belt means.

Both the upper 22 and lower 24 idler wheels are pivotable from a common pivot point which is typically attached to the engine. As the positioning means 26 is rotated, both of the idler arm means 18,20 are pivoted in either a clockwise or counterclockwise direction. The angular movement of each idler arm means 18,20 is controlled by the camming surface of its respective positioning cam 34,36. The cooperation between the movement of the upper idler arm 30 and the relative position of the intake camshaft with the exhaust camshaft is controlled by the upper cam 34. The relationship between the movement of the lower idler arm 32 and the tension in the belt means 16 is controlled by the lower cam 36.

The cam follower 44 for the upper idler arm 30 is positioned at the end of the cam follower leg and in this embodiment is the inside surface of predetermined shaped aperture. In a similar manner, the cam follower 48 for the lower idler arm 32 is positioned at the end of the cam follower leg and is also an inside surface of a predetermined shaped aperture.

Positioned in operative contact with the pulley wheel means or the camshaft means on the intake camshaft is a position sensor or thoothed trigger wheel. The function of the position sensor is to determine the present rotational position of the intake camshaft. This sensor generates an electrical signal which is supplied to the ECU 41. Within the ECU, the electrical signal is processed and generates digital information indicating the present cam position relative to the crankshaft.

Other forms of positioning sensors may be a linear variable resistor attached to the lower lever arm for sensing the position of the lever arm and hence the position of the intake camshaft. Still another is a trigger wheel on the intake camshaft utilizing a hall-effect sensor that "straddles" the teeth on the trigger wheel and generates signals for processing by the ECU.

Other various engine operating sensors 47, 43, 45, such as engine speed, crank position, coolant temperature, manifold pressure, throttle position, etc., generate signals for the ECU 41. The ECU addresses a look-up table in its memory and generates control signals to the motor means 28 to position the positioning means 26 to the desired cam position. The motor means 28 functions similar to a stepping motor in that it drives the gear 40 connected to its armature a predetermined number of angular steps or a to a predetermined angular position in response to the control signal. The gear 38 on the positioning means 26 is rotated to position the positioning means 26. As the positioning means 26 is being rotated, the cam followers 44,48 are pivoting the idler arms 18,20. Because the function of the two idler wheels 22,24 is different, their respective cam followers 44,48 and positioning cams cause each arm to pivot through a different angular amount.

As the idler arms 30,32 are pivoted, the wrap of the belt means 16 around the intake camshaft pulley 12 rotates the intake camshaft relative to the exhaust camshaft Thus, the cams controlling the intake valves change the opening and closing time of the intake valve as well as the timing of the maximum opening of the valve.

The variable camshaft timing system has been described in connection with the intake camshaft. It is to be understood that the timing system could be equally applied to the exhaust camshaft to rotate the exhaust camshaft relative to the intake camshaft. If this were done, the lower idler wheel 24 would be positioned to bear against the belt means 16 between the crankshaft pulley 14 and the exhaust camshaft pulley 10. However, it has been found that changing the relative timing of the intake camshaft has a greater percentage effect on engine performance than changing the relative timing of the exhaust camshaft. Further, the system could be modified to adjust both camshafts relative to each other and the crankshaft, but the percentage effect on engine performance, while greater than either of singular camshaft adjustments, is not significantly greater to justify the expense.

Referring to FIGS. 3, 4, 5 and 6, there is illustrated one embodiment of a variable timing system as may be found on a V-8 engine. In these FIGURES, while both ends of the engine are used in the variable timing system, it is understood that the system can be completely housed at either end of the engine. In FIG. 3, the front of the engine is illustrated. In this view, the pulley wheel means 50 on the crankshaft is a double pulley in that two belt means or chains 52, 54 are driven by the crankshaft. Since chains are used, the pulley wheel means are sprocket wheels.

The first chain 52 connects the crankshaft pulley wheel means 50 with a pulley wheel means 56 attached to the exhaust camshaft on the driver's side. The second chain 54 connects the crankshaft pulley wheel means 50 with a pulley wheel means 58 attached to the exhaust camshaft on the passenger's side.

As viewed in FIG. 3, the direction of rotation is clockwise for each shaft and pulley wheel means. This identifies the tension side of the chain on the right for each chain. On the slack side of each chain, a chain tensioner 60, 62 is positioned to maintain a predetermined tension in the chains 52, 54.

Figure 4:
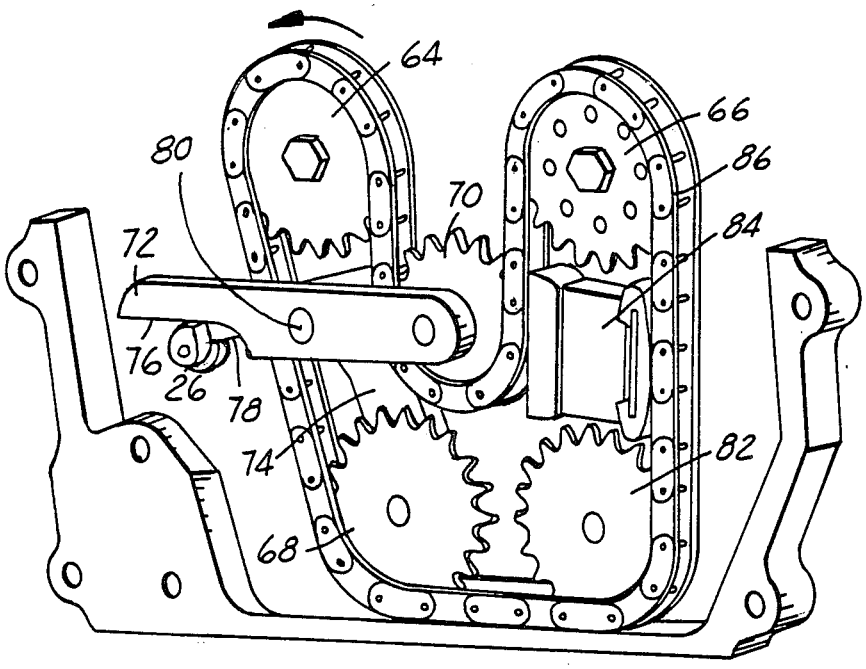
FIG. 4 is a rear view of the V-8 engine of FIGURE from the driver's side.

In the system of FIGS. 3–6, the exhaust camshaft (not shown) for each half of the "V" carries the drive from the front of the engine to rear. FIG. 4 illustrates a configuration which may be found on the driver's side. In this FIGURE, the direction of rotation is counterclockwise as shown by the arrow. The exhaust camshaft has a pulley wheel means 64 or sprocket wheel connected at the end thereof. In a similar manner the intake camshaft has another pulley wheel means 66 or sprocket wheel connected to the end thereof. Two idler sprocket wheels 68, 70 are positioned on either side of the pulley 66 being phased. Both of these two idler sprocket wheels 68, 70 are rotatively secured to an end of a first and second idler arm 72, 74. The opposite end of the first and second idler arm has a cam surface or follower means 76, 78 for coupling with the cams 34, 36 respectively of the positioning means 26 (FIG. 2). As illustrated, the first and second idler arms are both class "A" levers in that the pivot 80 for each lever is between the two ends of the arm.

Positioned between the intake camshaft pulley wheel means 66 and the idler pulley 68 on the second idler arm 74, is another pulley wheel means or idler sprocket wheel 82 which is fixedly mounted for rotation. The function of this idler sprocket wheel 82 is to provide a fixed location for travel of the chain to the intake camshaft pulley wheel means 66. This is necessary for the proper operation of the hydraulic chain tensioner 84 which is positioned intermediate the fixed idler sprocket wheel 82 and the intake camshaft pulley wheel means 66.

As previously discussed, the positioning means 26 is driven by a motor means 28 under the control of an ECU 41 in a manner similar to that described in FIGURE 1. The chain 86 is under tension from the intake camshaft pulley wheel means 66 which is the "load" to the exhaust camshaft pulley wheel means 64 in a counterclockwise direction. As the positioning means 26 rotates, the relative positions of the idler sprocket wheels 68, 70 on the idler arms 72, 74 is changed and the wrap of the chain 86 around the intake camshaft pulley wheel means 66 is changed. This operates to rotate the intake camshaft relative to the exhaust camshaft.

Figure 5:
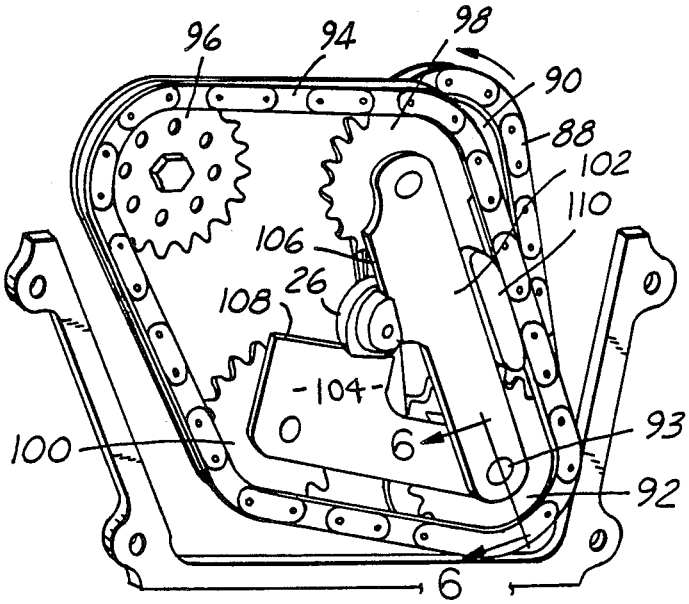
FIG. 5 is a rear view of the V-8 engine of FIGURE from the passenger's side.

Referring to FIG. 5, there is illustrated the right side or passenger side of the back of the engine of FIG. 3. In the FIGURE, the direction of rotation is counterclockwise as shown by the arrow for all chains of which there are two. The first chain 88 extends from the exhaust camshaft pulley wheel means 90 to a fixed pulley wheel means or idler sprocket wheel 92 which is fixedly mounted on a shaft or axle 93 for rotation. Both the exhaust camshaft pulley wheel means 90 and the idler sprocket wheel means 92 are hidden by the second chain 94. This fixed idler sprocket wheel 92 is driven by the rotation of the exhaust camshaft. As viewed in FIG. 5, the slack portion of the first chain 88 is along the left side of the chain and it is there that a chain tensioner (not shown) is positioned. The tension portion of the first chain 88 is along the right side from the "load" or fixed idler sprocket wheel 92 to the pulley wheel means on the exhaust camshaft in a counterclockwise direction.

The fixed idler sprocket wheel 92 is a double sprocket wheel in that two chains 88, 94 are connected thereto. The first chain 88 is connected to the exhaust camshaft pulley wheel means and the second chain 94, which is the outer chain in the FIGURE, is connected to the intake camshaft pulley wheel means 96. The tension portion of the second chain 94 is from the intake camshaft pulley wheel means 96 counterclockwise to the fixed idler sprocket wheel 92 and the slack portion is from the fixed idler sprocket wheel counterclockwise to the intake camshaft pulley wheel means. As in the previous set-ups of FIGS. 1 and 4, a pair of rotatable and moveable idler sprocket wheels 98, 100 are positioned on either side of the intake camshaft pulley wheel means 96.

In this FIGURE, the first and second idler arms 102, 104, have their pivot at one end, the idler sprocket wheel 98, 100 at the other end and a cam follower means 106, 108 intermediate the two ends. The positioning means 26 is fixedly positioned for rotation so as to couple with the idler arms 102, 104 at the cam follower means 106, 108. Since the belt means is a chain 94, a chain tensioner 110 is used to maintain the tension in the chain at a predetermined value. Since it is a requirement that the chain tensioner 110 be positioned between two fixed sprocket wheel centers, a special idler arm 102 is needed.

As illustrated in FIG. 6, this idler arm 102, which is the upper or first idler arm in the FIGURE, has its pivot end on the shaft 93 at the fixed idler sprocket wheel 92 which is driven by the exhaust camshaft. The other end of the first idler arm 104 is fixed to the axle of the idler sprocket wheel means 98. Since these two centers are fixed relative to each other, the chain tensioner 110 can be mounted to the first idler arm 102.

Since the idler arm pivots about the fixed idler sprocket wheel axle 93, the only location that an oil supply can be attached to the hydraulic chain tensioner is through the pivot axle. As illustrated in FIG. 6, the pivot axle 93 has a closed or blind bore 112 or passageway which comes from the oil supply 114. Near the closed end of the passageway, there is a transverse passageway 116 extending in a radial direction to an arcuate slot 118 along the surface of the axle. Mating with the arcuate slot 118 and in the first idler arm 102 is an oil passageway 120 for transporting oil from the slot 118 to the hydraulic tensioner mechanism 110.

Also illustrated in FIG. 6, is one embodiment of the mounting of the fixed pulley wheel means 92 to the pivot axle. As illustrated, the double sprocket wheel 92 is mounted for rotation by a bearing means 122. Also illustrated is the mounting of the first and second idler arms 102, 104 for rotational movement. Since this mechanism is enclosed by an oil cover, not shown, there is sufficient lubrication available.

Figure 7:
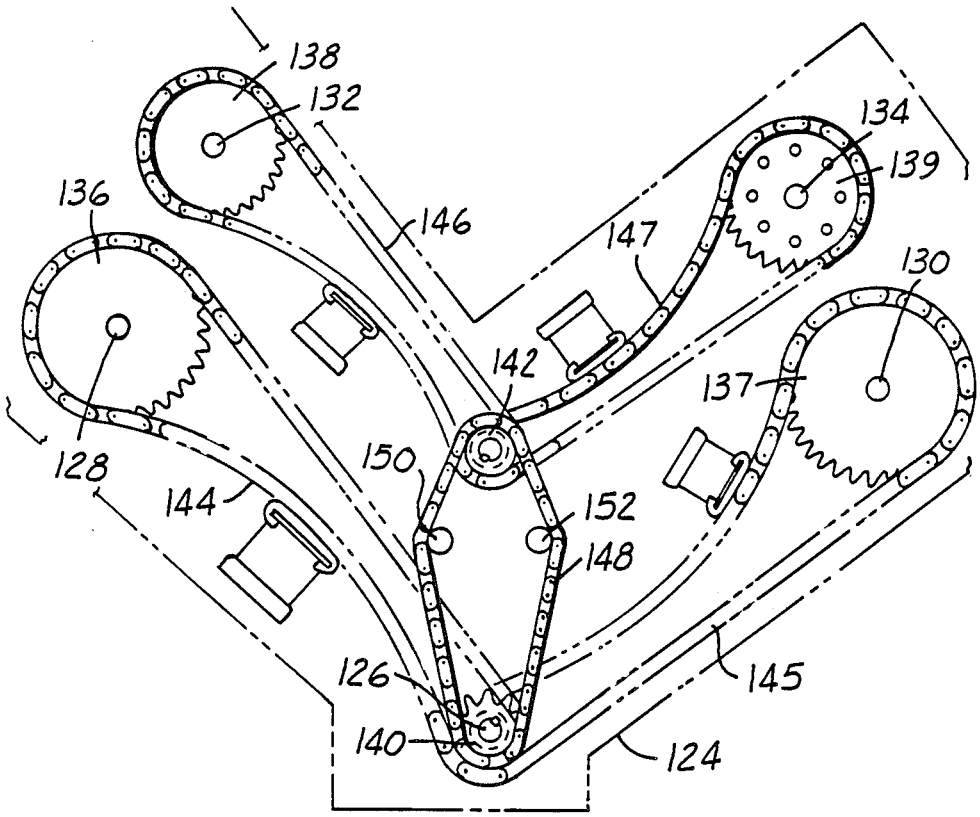
FIG. 7 is another embodiment of the variable timing systems as may be found on a V-8 type engine.

Referring to FIG. 7, there is illustrated another embodiment of a variable timing system as used in combination with a "V" type internal combustion engine 124. The engine has an engine crankshaft 126 or moveable member and an exhaust camshaft 128, 130 mounted for rotation in each arm of the "V". Each of the exhaust camshafts has at least one exhaust cam for controlling the opening and closing of at least one exhaust valve. The engine has an intake camshaft 132, 134 mounted for rotation in each arm of the "V". Each of the intake camshafts has at least one intake cam for controlling the opening and closing of at least one intake valve.

A pulley wheel means 136-139 is mounted on each of the exhaust camshafts 128, 130 and intake camshafts 132, 134. In this embodiment, the pulley wheel means on each camshaft is a single pulley wheel. In addition there are at least two multiple pulley wheels 140, 142, with one mounted on the crankshaft and the other coupled to the engine for rotation and in line with the multiple pulley wheel 140 on the crankshaft. As illustrated in FIG. 7, each of these multiple pulley wheels are in effect three pulley wheels. A belt or chain 144-148 interconnects each one of the pulley wheels with another of the pulley wheels In the embodiment of FIG. 7 there are five chains or belts.

At least two idler wheels 150, 152 are positioned in operative contact with the belt 148 interconnecting the multiple pulley wheel means 142 coupled to the engine and the pulley wheel means 140 mounted on the crankshaft.

A pair of levers similar to that illustrated in FIG. 5, is pivotally mounted to support the two idler wheels 150, 152. Each of the levers has a caming surface in operative contact with a positioning cam means. The positioning cam means, similar to that illustrated in FIG. 2, rotates the intake camshafts 132, 134 relative to the exhaust camshafts 128, 130.

Figure 8:
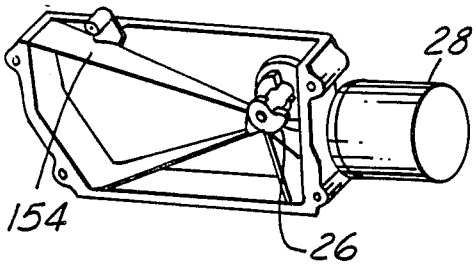
FIG. 8 is an assembly of the positioning means, control means and sensor means.
Figure 9:
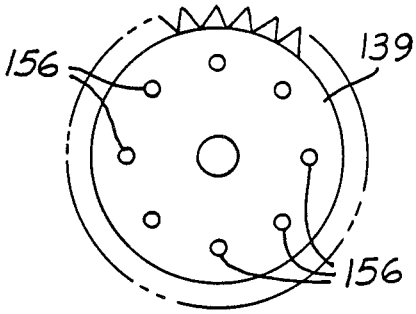
FIG. 9 is a pulley wheel means having means for indicating the timing positioning of the cylinders of the engine.

One assembly of a sensing means 154 along with the positioning means 26 and motor means 28 is illustrated in FIG. 8. The sensing means 154 is in operative contact with one of the intake camshafts 134 for sensing the angular position of the intake camshaft 134. The sensing means 154 generates an electrical signal which is supplied to the control means 41 for positioning the positioning cam means 26. FIG. 9 illustrates one embodiment of an intake pulley wheel means 139 having a plurality of indicating means 156 indicating the timeing position such as top dead center of each cylinder.

An alternate embodiment, of that illustrated in FIG. 7 is where both the front and rear of the engine must be used. In such a system, a double pulley means mounted at one end of the crankshaft and in line with the pulley wheels mounted on the exhaust camshafts at one end of the engine such as the front. A single pulley wheel means mounted at the other end of the crankshaft at the rear of the engine and inline with a triple pulley wheel means that is coupled to the engine.

Figure 10:
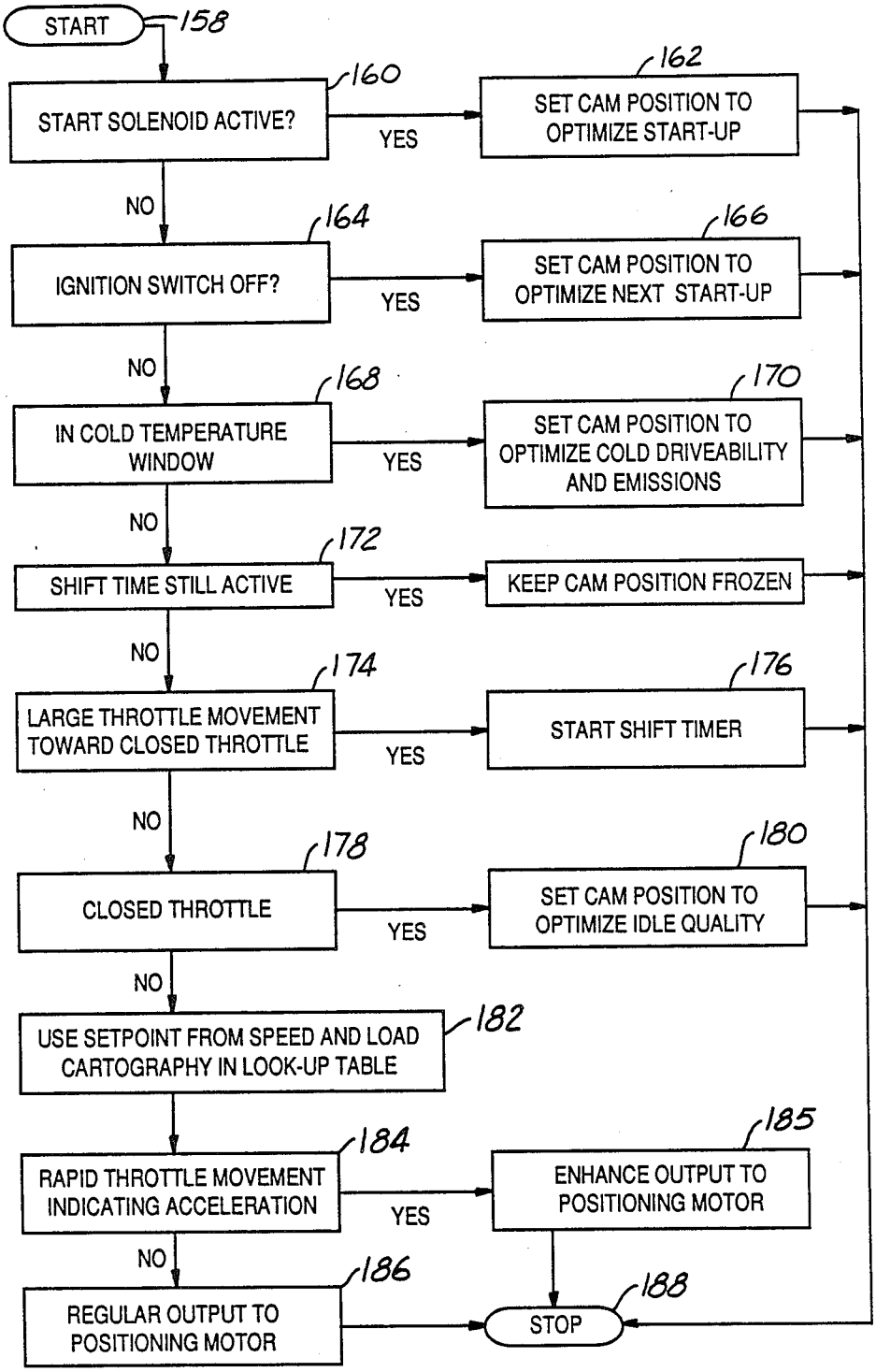
FIG. 10 is a flow chart of the operating system for controlling the variable camshaft timing mechanism of FIG. 1.

Referring to FIG. 10, there is illustrated a flow chart of the method of accomplishing the variable valve timing by means of an ECU 41 and a motor means 28. The method described herein is applicable to the systems of FIGS. 1, 3 and 7. The program is begun through a normal interrupt 158 procedure of a microprocessor such as Motorola's 68HC11 . The program determines 160 if the starter solenoid is active or "on". If it is, this is an indication of that the internal combustion engine is being started. The program then addresses 162 a particular memory location having the set-up parameters for optimizing the start-up procedures.

The memory has a look-up table which has been created for the particular engine so that at any given engine speed and engine load, the torque, idle quality, and fuel economy are optimized and the emissions are kept to a minimum and within standards. To accomplish this, the table, for a given engine speed and engine load, has the intake cam positioning to achieve best engine performance.

To determine if the engine is in a crank condition or start-up, the starter solenoid current or voltage is sensed by either being present or not, a digital "on" or "off" condition, and a signal is generated which addresses the look-up table and the intake cam position is optimized for startability.

If the start solenoid is not active, the program then checks the electrical condition or status of the ignition switch 164. The ignition "off" condition is only sensed when the engine is shut down. The ECU controls its own power-down routine through the use of a latch relay means. During the power-down routine, the ECU can position the cam based on the present conditions for the next start routine 166, before the ECU completely power downs and shuts off. If the engine is attempting to be started, the ignition switch is not "off" and the program checks 168 the various temperature sensors such as engine coolant, to determine if the engine should be optimized for cold starting.

If the engine is being cold started, the table is addressed and the optimum cam position is determined 170. This value is compared with the present position of the cam as indicated by the position sensor and the resultant error generates motor control signals for controlling the motor to position the positioning means for varying the cam timing. In the preferred embodiment, this changes the opening time of the intake cams.

The next condition 172 to be tested is to determine if the shift timer is still active. For the purposes of description, it is considered that the timer is not active. Next the program addresses 174 the throttle position sensor and determines if the throttle is being moved toward a closed position. This condition is found during the manual shifting of a transmission. In this case, the cam timing of the engine should not be changed. However, when this happens, the system will only recognize this condition for a period of time 176 as determined by a shift timer which is started when the the rapid closing of the throttle occurs.

If the throttle position sensor indicates that the throttle is closed 178 indicating an idle condition, the look-up table is addressed 180 and the correct cam position is supplied to the motor control to optimize idle quality.

If the program has not found any of the previous conditions present, the look-up table is addressed 182 according to the engine speed and engine load and the correct cam position is supplied to the motor control to optimize the engine operation. This procedure is followed many times during engine operation.

At this point in the program, the engine is running and the throttle position sensor is addressed 184 to determine if there is rapid throttle movement indicating that the engine is being accelerated. The derived cam positioning value is not affected, but the program amplifies 185 the command signal to the motor control to achieve the fastest possible response. Under normal conditions, the motor control signal is a function of the resultant error between the table cam position and the present position of the cam and the larger the "error", the larger the command signal and the faster the motor responds.

If the throttle position sensor indicates that the throttle is not being moved rapidly, the look-up table 186 is addressed according to the present engine speed and engine load and the optimal cam setting is supplied to the motor control.

In FIG. 10 the block 188 labeled STOP indicates that the program or the method is ended until another interrupt is sensed and the method or program is run again.

Many changes and modifications in the above described embodiment of the invention can, of course, be carried out without departing from the scope thereof. Accordingly, that scope is intended to be limited only by the scope of the appended claims.

We claim:

1. A variable timing system in combination with an internal combustion engine having an engine crankshaft or moveable member, an exhaust camshaft mounted for rotation and extending from the engine, said exhaust camshaft having at least one exhaust cam for controlling the opening and closing of at least one exhaust valve, and an intake camshaft mounted for rotation on the engine, said intake camshaft having at least one intake cam for controlling the opening and closing of at least one intake valve, said system comprising:

a first pulley wheel means fixedly attached to one end of each of the exhaust camshaft and the crankshaft of the engine;

a first belt means for interconnecting said first pulley wheel means for transferring rotational drive from the crankshaft to the exhaust camshaft;

a second pulley wheel means fixedly attached to each of the exhaust camshaft and one end of the intake camshaft at opposite end of the engine;

a second belt means for interconnecting said second pulley wheel means for transferring rotational drive from the crankshaft via the exhaust camshaft to the intake camshaft;

idler arm means including a pivoting arm, a cam follower means and an idler wheel in operative contact with a portion of said second belt means;

positioning cam means operatively coupled to said cam follower means of said idler arm means, for relatively rotating said second pulley wheel means attached to said one end of the intake camshaft with said second pulley wheel means attached to said opposite end of the exhaust camshaft;

a control means responsive to various engine operating parameters for generating motor control signals; and motor means responsive to said motor control signals and operatively coupled to rotate said positioning cams means for positioning said idler arm means for changing the relative rotational position between the input camshaft and the exhaust camshaft.

2. A variable camshaft timing system for an internal combustion engine according to claim 1 wherein said control means includes an electronic control unit having a plurality of sensor means each responsive to one of a plurality of engine operating parameters and a look-up means responsive to two of said engine operating parameters for generating a desired position electrical signal indicating the relative rotational position of said intake camshaft and said exhaust camshaft and generating said motor control signals in response thereto.

3. A variable camshaft timing system for an internal combustion engine according to claim 1 wherein said belt means is a chain means.

4. A variable camshaft timing system for an internal combustion engine according to claim 1 additionally including means for sensing the present rotational position of said intake camshaft and generating a present position electrical signal; and means for comparing said present position electrical signal and said desired position electrical signal for deriving an error signal indicating the direction and angular rotation of said positioning cam means.

5. A variable timing system in combination with a "v" type internal combustion engine having an engine crankshaft or moveable member, an exhaust camshaft mounted for rotation in each arm of the "V", each of the exhaust camshafts having at least one exhaust cam for controlling the opening and closing of at least one exhaust valve, and an intake camshaft mounted for rotation in each arm of the "V", each of the intake camshafts having at least one intake cam for controlling the opening and closing of at least one intake valve, said system comprising:

pulley wheel means mounted on each of the exhaust camshafts and intake camshafts;

at least two multiple pulley wheel means one mounted on the crankshaft and the other coupled to the engine for rotation and in line with said multiple pulley wheel means on the crankshaft;

belt means interconnecting each one of said pulley wheel means with another of said pulley wheel means;

at least two idler wheels in operative contact with said belt means interconnecting said multiple pulley wheel means coupled to the engine for rotation and said pulley wheel means mounted on the crankshaft;

lever means pivotally mounted for supporting said idler wheels, said lever means having a caming surface, positioning cam means in operative contact with said caming surface for pivoting said lever means for rotating the intake camshaft relative to the exhaust camshaft;

means sensing the angular position of one of the intake camshafts; and control means responsive to said means sensing the angular position of one of the intake camshafts for positioning said positioning cam means.

6. A variable timing system according to claim wherein said belt means comprises five chains.

7. A variable timing system according to wherein said multiple pulley wheel means includes a double pulley means mounted at one end of the crankshaft and in line with said pulley wheel means mounted on the exhaust camshafts at one end of the engine, a single pulley wheel means mounted at the other end of the crankshaft and a triple pulley means coupled to the engine for rotation and in line with said single pulley wheel means on the crankshaft.

8. A variable timing system in combination with an internal combustion engine having an engine crankshaft or moveable member, an exhaust camshaft mounted for rotation and extending from the engine, said exhaust camshaft having at least one exhaust cam for controlling the opening and closing of at least one exhaust valve, and an intake camshaft mounted for rotation on the engine, said intake camshaft having at least one intake cam for controlling the opening and closing of at least one intake valve, said system comprising:

pulley system means attached to one end of each of the crankshaft, exhaust camshaft and intake camshaft, said pulley system means comprising multiple pulley wheel means on at least one of the crankshaft and exhaust camshaft;

belt means interconnecting said pulley system means;

at least two idler wheels in operative contact with said belt means around said pulley system means on the intake camshaft;

lever means pivotally mounted for supporting said idler wheels, said lever means having a caming surface;

positioning cam means in operative contact with said caming surface for pivoting said lever means for rotating the intake camshaft relative to the exhaust camshaft;

means sensing the angular position of the intake camshaft;

control means responsive to said means sensing the angular position of the intake camshaft for positioning said positioning cam means; and wherein said pulley system means on the exhaust camshaft is located at both ends of the exhaust camshaft and the pulley system means on the intake camshaft is located at the opposite end of the engine as the pulley system means on the crankshaft.

* * * * *